United States Patent [19]

Dalebout

[11] 4,351,120

[45] Sep. 28, 1982

[54] REMOVABLE TRACTION SURFACES FOR FOOTWEAR

[75] Inventor: Melvin W. Dalebout, Salt Lake City, Utah

[73] Assignee: Engineered Sports Products, Inc., Salt Lake City, Utah

[21] Appl. No.: 168,079

[22] Filed: Jul. 14, 1980

Related U.S. Application Data

[60] Continuation-in-part of Ser. No. 48,986, Jun. 15, 1979, Pat. No. 4,301,564, which is a division of Ser. No. 883,460, Mar. 6, 1978, Pat. No. 4,182,056, which is a continuation-in-part of Ser. No. 711,476, Aug. 4, 1976, Pat. No. 4,078,322.

[51] Int. Cl.[3] ..... A43B 5/04

[52] U.S. Cl. ..... 36/117; 36/135

[58] Field of Search ..... 36/117, 118, 119, 120, 36/121, 135

[56] References Cited

U.S. PATENT DOCUMENTS

| | | | |
|---|---|---|---|
| 1,615,032 | 1/1927 | Palmquist | 36/117 |
| 3,243,902 | 4/1966 | Chapman | 36/135 |
| 3,775,875 | 12/1973 | Dvorsky | 36/117 |
| 4,182,056 | 1/1980 | Dalebout | 36/117 |
| 4,301,564 | 11/1981 | Dalebout | 36/117 |

*Primary Examiner*—Patrick D. Lawson

*Attorney, Agent, or Firm*—Trask & Britt

[57] ABSTRACT

A ski boot is constructed with a relatively rigid bottom foot enclosure adapted to couple with a bottom traction component comprised of heel and sole portions. Traction components with traction surfaces of varying characteristics, dependent upon their intended use, may be interchangeably installed on the boot through snap lock elements integral with the foot enclosure and traction components.

17 Claims, 5 Drawing Figures

REMOVABLE TRACTION SURFACES FOR FOOTWEAR

RELATED APPLICATIONS

The present application is a continuation-in-part of commonly assigned U.S. application Ser. No. 48,986, filed June 15, 1979, now U.S. Pat. No. 4,301,564, as a division of U.S. application Ser. No. 883,460, filed Mar. 6, 1978, for "Pliable Inner Boot and Injectable Fit Packs For Ski Boots," now U.S. Pat. No. 4,182,056; which was a continuation-in-part of commonly assigned U.S. application Ser. No. 711,476, filed Aug. 4, 1976, for "Ski Boot", now U.S. Pat. No. 4,078,322. The grandparent application discloses and claims a ski boot with a rigid outer shell adapted to removable traction surfaces together with a novel removable inner boot. The parent application discloses the same type of outer boot and inner boot and claims specific details of an improved inner boot of that type. The present application pertains to similar rigid outer shells for boots adaptable for skiing or other recreational pursuits, having removable traction components of improved design.

The disclosures of the parent and grandparent applications are incorporated herein by reference.

BACKGROUND OF THE INVENTION

1. Field

This invention pertains to boots with relatively rigid bottom foot enclosures, such as those used for skiing, mountain climbing and skating. Specifically, it provides removable traction components for such boots of a type which are readily interchangeable without the use of auxiliary fasteners.

2. State of the Art

Over the past several years, ski boots have evolved through several stages from stiff unlined boots of leather to the present rigid outer boot shells (generally of plastic) with flexible liners of various types. For use with modern bindings, it is essential that the outer boot be stiff to optimize the control effected on the skis by a skier shifting his weight or the attitude of his feet. Similar criteria are significant in boots adapted for other purposes, such as mountain climbing, tournament skate boarding and roller skating. The equipment used in these activities is of high performance requiring excellent control and responsiveness to shifting of the position or attitude of the feet. Accordingly, although the present disclosure is directed primarily to ski boots, it should be understood that the invention disclosed and claimed herein finds application in any foot wear requiring traction surfaces on the bottom of stiff or rigid outer boots. In fact, an important aspect of this invention is the adaptation of boots normally used for skiing for use in other pursuits requiring a traction surface of somewhat different characteristics.

Modern plastic ski boots have typically been discarded when their traction surfaces became worn. Although the remainder of the boot may be in good condition, worn heels and soles make it difficult to retain the boots is ski bindings. Similar difficulties are experienced with boots adapted for mountain climbing, skate boarding, skating and the like.

SUMMARY OF THE INVENTION

The present invention provides a rigid foot enclosure adapted to removable traction components of substantially improved design over those disclosed and claimed by the grandparent application (now U.S. Pat. No. 4,078,322). The traction components of this invention may be of single piece construction, but preferably include separate sole and heel portions. They may incorporate selected cants, as disclosed by U.S. Pat. No. 4,078,322. The removable traction components of this invention have bottom traction surfaces and structural extensions. The extensions include sockets configurated to receive corresponding structural extensions from the rigid foot enclosure. Accordingly, when either the sole and/or heel becomes worn it may be replaced, thereby extending the useful life of the boot. In addition to the socket connections associated with the extensions from the outer shell and heel and sole portions, each portion includes apertures adapted to bosses extending from the bottom of the rigid foot enclosure. The bosses can be pressed through the apertures for a press fit engagement. The engagement is sufficiently tight to require a tool (e.g., a screwdriver) to pry the traction element loose from the foot enclosure. The traction elements may carry other components, such as roller skate trucks.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 4:
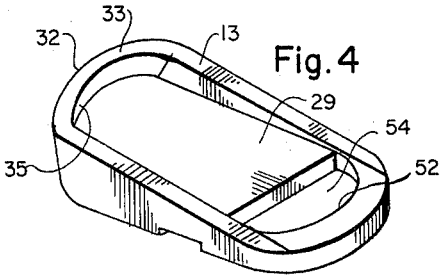
FIG. 4 is a perspective view of the heel portion of the traction element.

The drawings illustrate a bottom foot enclosure and traction elements of a ski boot similar in design and function to that disclosed and claimed by the grandparent patent application (now U.S. Pat. No. 4,078,322). The rigid foot enclosure 11 includes a bottom 12 adapted to couple with a heel element 13 and a toe element 14 illustrated best by FIGS. 4 and 5, respectively. These elements 13, 14 are constructed of material to provide a traction surface 17, 18, respectively, appropriate for the application intended of the foot enclosure 11. For example, while a durometer value of approximately 50-D (50 units on the shore D hardness scale) may be ideal for traction elements intended for skiing, either higher or lower values may be more appropriate for applications such as mountain climbing or skating. An important aspect of the present invention is that traction elements 13, 14 of varying physical characteristics; that is, of different durometer and/or different tread configuration, may be interchanged quickly to adapt a single rigid foot enclosure 11 to differing uses. Although a single member could replace the elements 13, 14, it is preferred to provide a separate heel 13 and toe 14 piece as shown.

Figure 1:
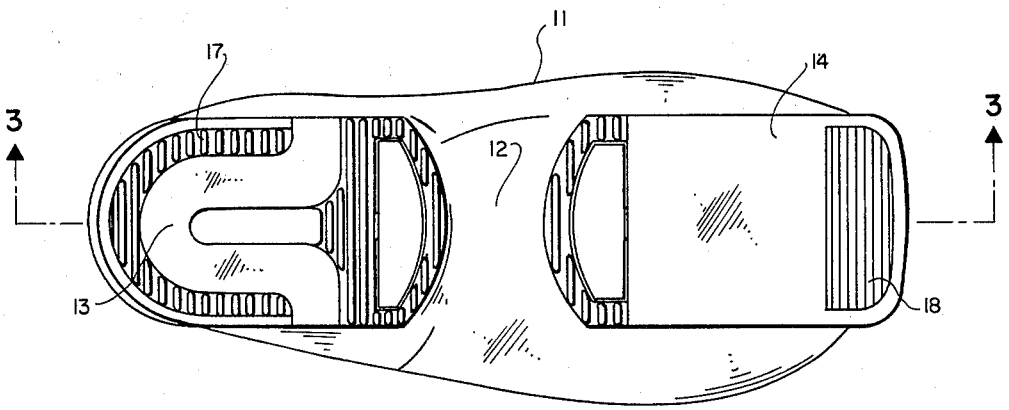
FIG. 1 is a plan view from the bottom of a rigid foot enclosure with the traction elements of this invention installed.
Figure 2:
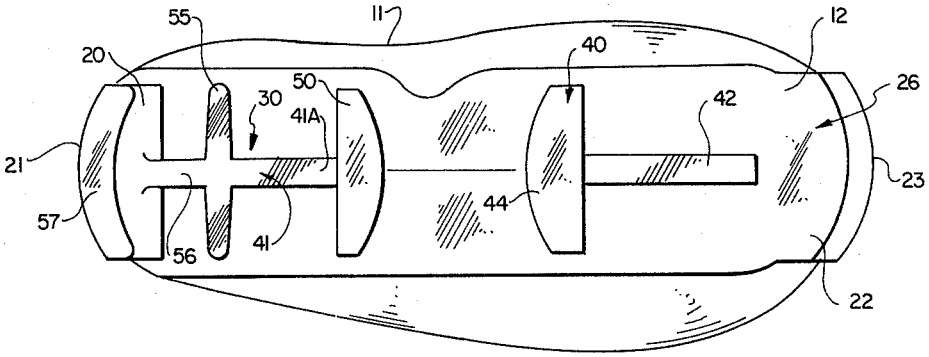
FIG. 2 is a similar view with the traction elements removed.

Referring specifically to FIG. 2, the bottom 12 of the foot enclosure 11 includes a structural member 20 with a tab or extension element 21. A similar structural member 22 at the front of the bottom 12 carries a tab or extension element 23.

The traction element 14 (FIG. 5) includes, in addition to the traction surface 18, an upper mating surface 25 adapted to mount flush against the corresponding portion 26 of the bottom 12, and a nose portion 27 adapted to interlock with the tab 23. The nose 27 includes an upper surface 28 which is substantially parallel the traction surface 18, and is spaced therefrom to constitute means for attachment (e.g., by clamping) to conventional toe binding apparatus of the type commonly mounted on alpine or downhill skis. The traction element 13 is similarly adapted with an upper surface 29 for mounting against the corresponding portion 30 of the bottom 12. It includes a tail portion 32 adapted to interlock with the extension 21 and carries an upper surface 33 substantially parallel the traction surface 17 and spaced therefrom to constitute means for attachment to conventional heel binding apparatus.

Various expedients for interlocking the nose 27 and tail 32 portions to the extensions 23 and 21, respectively, may be devised, but as illustrated, a recess 34 in the nose 27 beneath the surface 28 fits snugly over the extension 23 so that forces on the surface 28 are translated to the foot enclosure 11 through the extension 23. Similarly, a recess 35 fits snugly over the extension 21 so that forces on the surface 33 are translated to the foot enclosure 11 through the extension 21.

Figure 3:
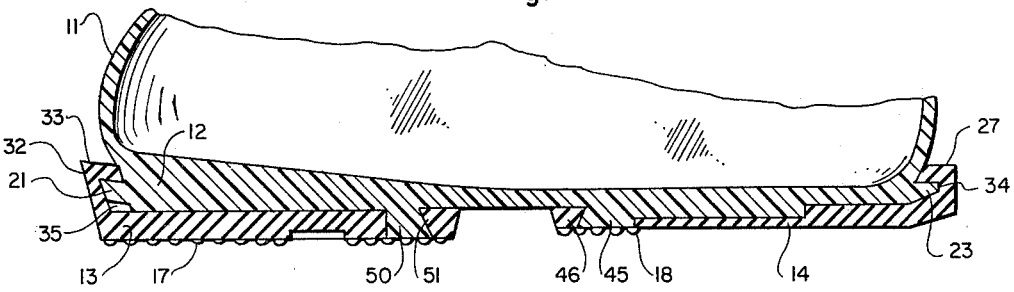
FIG. 3 is a view in cross-section taken along the section line 3—3 of FIG. 1 illustrating the manner in which the traction elements are coupled to the rigid foot enclosure.
Figure 5:
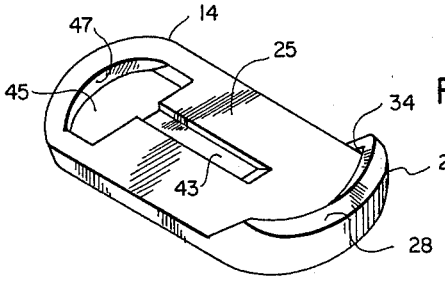
FIG. 5 is a view in perspective of the heel portion of the traction element.

Extending from the bottom 12 are a pair of special bosses 40 and 41, respectively, adapted to couple with the sole member 14 and heel member 13, respectively, and to provide both an anchoring connection for these members as well as lateral support. The boss 40 includes a front portion 42 extending longitudinal the center of the bottom 12 adapted to fit snugly within a corresponding groove 43 in the member 14. A second member 44 of substantial cross-section is keyed to a receiving aperature 45 in the member 14, and includes a wedged or inclined surface 46 (FIG. 3) conforming to a corresponding surface 47 (FIG. 5). These surfaces require distortion of the aperture 45 to effect a connection and hold the member 14 firmly against the bottom 12 when such a connection has been effected. The embossed portion 41 includes a central element 41A extending longitudinal the center of the bottom 12 and includes a lateral member 50 with an inclined surface 51 (FIG. 3) adapted to a corresponding surface 58 (FIG. 4) of the member 13 so that when the boss member 50 is inserted into the corresponding aperture 54, a similar wedged fit connection is effected for the heel member 13. The remaining lateral portions 55, 56, 57 terminate in coplaner surfaces to provide both lateral support for the member 13 and adequate bearing surface against the internal surface 28 of this member.

The members 13 and 14 are readily affixed to the rigid foot enclosure 11 by fitting the appropriate extension 21, 23 into the corresponding slot 35, 34 and then inserting a pry; e.g., a screwdriver blade, into the aperture 54, 45 to pry the inclined surface 52, 47 over the corresponding boss surface 51, 46. Removal of the members 13, 14 is effected by prying these inclined surfaces over the corresponding boss surfaces.

It is within contemplation that the elements 13, 14 may be specifically adapted to carry trucks for roller skates. It is also contemplated that these elements 13, 14 may carry structure specifically adapted to cross-country ski bindings or other apparatus. A single boot shell may in this fashion be adapted to a plurality of uses, although the replacement of elements 13, 14 is advantageous whether or not the boots are used for more than one pursuit.

Reference herein to details of the illustrated embodiments is not intended to limit the scope of the claims, which themselves recite those features regarded as essential to the invention.

I claim:

1. In a ski boot having a rigid foot enclosure adapted for releasable mounting atop a ski, including a traction member detachable from said foot enclosure with an upper mating surface for attachment adjacent the bottom of said foot enclosure, the improvement comprising:

boss means carried by the bottom of said foot enclosure, including an inclined surface;

aperture means carried by said traction member and arranged to register with said boss means, including an inclined surface mutually adapted with the inclined surface of said boss means to lock the upper mating surface of the traction member against the bottom of said foot enclosure in a press fit engagement, said traction member including:

a sole portion carrying means for engagement by a ski toe binding apparatus; and a heel portion carrying means for engagement by a ski heel binding apparatus.

2. An improvement according to claim 1, wherein said sole and heel portions are adapted to interlock with said foot enclosure so that forces applied by a binding apparatus to said traction member are translated to said foot enclosure and not directly to the interface between said foot enclosure and said mating surface.

3. An improvement according to claim 2, wherein said foot enclosure includes a toe end with a first integral structural extension adapted to interlock with said sole portion of said traction member and a heel end with a second integral structural extension adapted to interlock with said heel portion of said traction member.

4. An improvement according to claim 3 wherein said sole and heel portions are discrete segments.

5. An improvement according to claim 4, wherein said sole segment includes a forwardly projecting element with an upper toe surface adapted for gripping by a toe binding and a socket portion between said upper toe surface and said traction surface configurated to receive a first structural extension from said foot enclosure; and said heel segment includes a rearwardly projecting element with an upper heel surface adapted for gripping by a heel binding and a socket portion between said upper heel surface and said traction surface configurated to receive a second structural extension from said foot enclosure.

6. An improvement according to claim 1, wherein said upper mating surface is canted a selected degree with respect to said traction surface so that the foot enclosure is held at a selected cant with respect to a said ski when said ski boot is mounted thereon.

7. An improvement according to claim 6 including in combination a plurality of interchangeable said sole and heel portions from which may be selected the sole portion and heel portion required to adapt said ski boot to a particular individual.

8. An improvement according to claim 1, wherein the bottom of the foot enclosure includes a toe portion with a boss; including a front portion extending longitudinal the center of the bottom adapted to fit snugly within a corresponding groove in the traction member, and a second member of substantial cross-section, including said inclined surface, locked into an aperture in said traction member.

9. An improvement according to claim 1, wherein the bottom of the foot enclosure includes a heel portion with a boss including a central portion extending longitudinal the center of the bottom and a plurality of lateral portions, one of which includes said inclined surface, all of said boss portions terminating in a common plane adjacent said bottom.

10. An improvement according to claim 9, wherein the bottom of the foot enclosure includes a toe portion with a boss including a front portion extending longitudinal the center of the bottom adapted to fit snugly within a corresponding groove in the traction member and a second member of substantial cross-section, including said inclined surface, locked into an aperture in said traction member.

11. An improvement according to claim 10, wherein the traction member is comprised of two discrete segments adapted to the toe portion and heel portion, respectively, of the bottom.

12. A rigid athletic boot with a bottom traction member detachable from the bottom of said boot and including an upper mating surface for attachment adjacent said bottom, comprising:

boss means carried by the bottom of said foot enclosure, including an inclined surface; and aperture means carried by said traction member and arranged to register with said boss means, including an inclined surface mutually adapted with the inclined surface of said boss means to lock the upper mating surface of the traction member against the bottom of said foot enclosure in a press fit engagement;

wherein said upper mating surface is canted a selected degree with respect to said traction surface so that the foot enclosure is held at a selected cant with respect to a said traction surface.

13. An improvement according to claim 12 including in combination a plurality of interchangeable said sole and heel portions from which may be selected the sole portion and heel portion required to adapt said athletic boot to a particular individual.

14. A rigid athletic boot with a bottom traction member detachable from the bottom of said boot and including an upper mating surface for attachment adjacent said bottom, comprising:

boss means carried by the bottom of said foot enclosure, including an inclined surface; and aperture means carried by said traction member and arranged to register with said boss means, including an inclined surface mutually adapted with the inclined surface of said boss means to lock the upper mating surface of the traction member against the bottom of said foot enclosure in a press fit engagement;

wherein the bottom of the foot enclosure includes a toe portion with a boss including a front portion extending longitudinal the center of the bottom adapted to fit snugly within a corresponding groove in the traction member and a second member of substantial cross-section, including said inclined surface, locked into an aperture in said traction member.

15. A rigid athletic boot with a bottom traction member detachable from the bottom of said boot and including an upper mating surface for attachment adjacent said bottom, comprising:

boss means carried by the bottom of said foot enclosure, including an inclined surface;

aperture means carried by said traction member and arranged to register with said boss means, including an inclined surface mutually adapted with the inclined surface of said boss means to lock the upper mating surface of the traction member against the bottom of said foot enclosure in a press fit engagement;

wherein the bottom of the foot enclosure includes a heel portion with a boss including a central portion extending longitudinal the center of the bottom and a plurality of lateral portions, one of which includes said inclined surface, all of said boss portions terminating in a common plane adjacent said bottom.

16. An improvement according to claim 15, wherein the bottom of the foot enclosure includes a toe portion with a boss including a front portion extending longitudinal the center of the bottom adapted to fit snugly within a corresponding groove in the traction member and a second member of substantial cross-section, including said inclined surface, locked into an aperture in said traction member.

17. An improvement according to claim 16, wherein the traction member is comprised of two discrete segments adapted to the toe portion and heel portion, respectively, of the bottom.

* * * * *